United States Patent [19]

Takada

[11] Patent Number: 4,575,907

[45] Date of Patent: Mar. 18, 1986

[54] LATCH BUCKLE FOR SEAT BELT

[76] Inventor: Juichiro Takada, 12-1, 3 chome, Shinmachi, Setagaya-ku, Tokyo, Japan

[21] Appl. No.: 648,656

[22] Filed: Sep. 7, 1984

[30] Foreign Application Priority Data

Sep. 12, 1983 [JP] Japan ..... 58-140297[U]

[51] Int. Cl.[4] ..... A44B 11/25

[52] U.S. Cl. ..... 24/641; 24/637; 24/643; 24/645

[58] Field of Search ..... 24/633, 637, 641, 643, 24/644, 645

[56] References Cited

U.S. PATENT DOCUMENTS

| | | | |
|---|---|---|---|
| 4,182,008 | 1/1980 | Pouget | 24/645 |
| 4,358,879 | 11/1982 | Magyar | 24/641 |
| 4,384,391 | 5/1983 | Lindblad et al. | 24/633 |
| 4,388,746 | 6/1983 | Krautz et al. | 24/643 |
| 4,393,557 | 7/1983 | Schmidt | 24/643 |
| 4,394,792 | 7/1983 | Schmidt | 24/637 |
| 4,454,634 | 6/1984 | Haglund et al. | 24/645 |
| 4,492,007 | 1/1985 | Tolfsen | 24/637 X |

*Primary Examiner*—Francis K. Zugel
*Assistant Examiner*—Peter A. Aschenbrenner
*Attorney, Agent, or Firm*—Brumbaugh, Graves, Donohue & Raymond

[57] ABSTRACT

A seat belt latch buckle includes a buckle body that releasably accepts and latches a buckle tongue. The buckle body includes a frame, a latch plate having a latching projection and pivotable in the frame, a release member to release the tongue, and an ejector to eject the released tongue. A control member is slidable on the latch plate between first and second positions. In the first position the control member is engaged between a portion of frame and the latch plate to positively lock the latch plate in the latched position. The release member slides the control member to the second position, in which it no longer prevents the latch plate from moving to the release position, before it engages the latch plate to pivot it and release the tongue.

2 Claims, 4 Drawing Figures

LATCH BUCKLE FOR SEAT BELT

DESCRIPTION

1. Field of the Invention

The present invention relates to a latch buckle for the seat belt of a vehicle and, more particularly, to a latch buckle having a buckle body adapted to accept a buckle tongue, said buckle body including a generally U-shaped frame, a generally L-shaped latch plate pivotably supported between the two side walls of the frame and having a latching portion engageable with the tongue, spring means to urge the latch plate to a latched position, a pusher member slidable parallel to the base plate of the frame and engageable with the latch plate to pivot the same to a released position, and an ejector slidable along the base plate to urge the released tongue out of the buckle body.

2. Description of the Prior Art

Various types of latch buckles have been used to connect or release vehicle seat belts. Among the desired characteristics for such buckles are the capabilities of being easily done up and easily released by a small operational force, of being maintained in the latched position, even when a high impact force is applied, and of being simple to manufacture at low cost.

Generally, the latch buckles of the prior art have a latch plate having a latching portion that engages the tongue, the latch plate being urged only by spring force to the latched position. When the force required to release the buckle is reduced by decreasing such spring force, so also is the retaining force between the tongue and the latching portion decreased. Thus, when an impact force, such as caused by a vehicle collision, is applied to the seat belt, the latch plate displaces by an inertial force and releases the tongue from the buckle body. To eliminate such inertial release, the spring force must be very strong, which means an increase in the force required to release the latch plate from the tongue.

In particular, a known seat belt latch buckle has a U-shaped frame having a base and a pair of side walls, a generally L-shaped latch plate pivotably supported by reception of side extensions in triangular-shaped holes in the side walls and having a latching portion engageable with the tongue, a spring urging the latch plate toward the latching position, a release member movable parallel to the frame base and engageable with the latch plate to pivot it out of the latch position and an ejector resiliently urged along the frame base to push the released tongue out of the buckle body. The spring that holds the latch plate in the latched position has to apply a force great enough to prevent the latch plate from releasing the tongue by being moved by an inertial force in a collision. Accordingly, the force required to move the release member to release the latch plate from the tongue is correspondingly large, which can cause difficulties and annoyance to the user.

To alleviate this problem, mechanisms are added to lock the latch plate in the latched position when the tongue is inserted. However, known mechanisms are complicated, and some do not positively retain the latch plate.

SUMMARY OF THE INVENTION

It is an object of the present invention to provide the latch buckle of the above-mentioned type with a means to lock the latch plate positively in the latched position while retaining ease of operation of the release member with a low force.

The present invention is characterized in that a control member is slidable on the latch plate between a first position in which it is engaged between a portion of the frame and the latch plate to prevent the latch plate from pivoting from the latched position engaging and holding the tongue and a second position in which it allows pivoting of the latch plate to the tongue-release position, and in that the control member has a portion engageable by the release member so that when the release member is moved to release the tongue, it moves the control member to the second position before it engages the latch plate.

As the control member slides into the latch plate locking position (the first position) after the tongue is inserted into the latch body, and also as the control member is inserted between the frame and the latch plate, the impact force and tongue-pulling force is applied through a flat surface of the control member to the frame. Thus, positive locking of the latch plate in the latched position is very simply accomplished.

The invention will become more fully apparent from the following detailed description of one preferred embodiment thereof, by way of example, taken in conjunction with the accompanying drawings.

BRIEF DESCRIPTION OF THE DRAWINGS

FIGS. 1–3 are longitudinal cross-sectional views of the embodiment of the latch buckle according to the present invention showing operational conditions in which:

FIG. 1 is the rest or cocked-and-ready position;

FIG. 2 is latched position;

FIG. 3 is the tongue release position; and

DESCRIPTION OF THE PREFERRED EMBODIMENT

Figure 4:
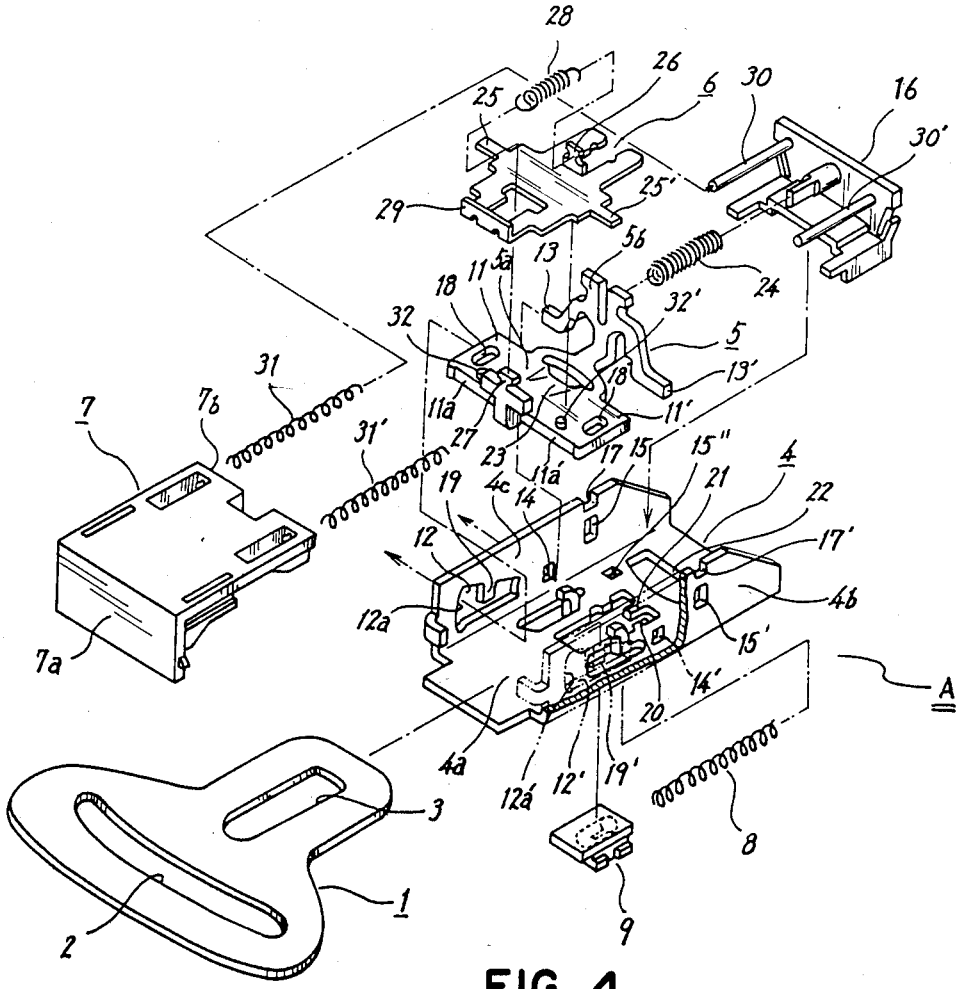
FIG. 4 is an exploded view of the latch buckle shown in FIGS. 1–3.

The reference numeral 1 designates a conventional tongue which has a belt-connecting slot 2 at one end, and a latch hole 3 at the other end. A buckle body A adapted to accept and release the tongue 1 comprises a frame 4, a latch plate 5 which is pivotably connected with the frame 4, a control member 6 which is slidable in the frame 4 to control the movement of the latch plate 5, a pusher or release member 7 to release the tongue 1 from the latch plate 5, an ejector 9 which ejects the tongue 1 from the frame 4 by a spring 8, and a cover 10 which is shown in phantom in FIG. 1 to cover the assembled body A. The elements of the buckle body A and the assembly thereof are shown in FIG. 4 in detail.

The frame 4 of the buckle body A is a generally U-shaped plate having a base **4*a* and side walls 4*b* and 4*c* which project upward from the side edges of the base 4*a*. The side walls 4*b* and 4*c* have, moving sequentially from the tongue-accepting end, segmental arc windows 12 and 12', which receive extensions 11 and 11' from the sides of the latch plate 5, pivot holes 14 and 14', which receive pivot shaft portions 13 and 13' of the latch plate 5, and openings 15 and 15' and notches 17 and 17', which in conjunction with openings 15'' in the base plate 4*a* retain a spring support plate 16 in place. The segmental arc windows 12 and 12' have downwardly projecting lugs 19 and 19'** which are accepted in holes 18 and 18' formed in the extensions 11 and 11' of the latch plate 5 when the latch plate 5 pivots upward to the release position, as described in detail below. The arcuate front edges 12a and 12a' of the windows 12 and 12' oppose front edges 11a and 11a' of the extensions 11 and 11' of the latch plate 5 with a small clearance so that a tension load applied to the latch plate 5 is transmitted directly to the frame 4.

The central portion of the frame base 4a has an opening 20 which receives the ejector 9 for sliding in the tongue-inserting direction. The rear edge of the opening 20 has a spring seat portion 21 that carries the spring 8 which urges the ejector 9 to push out the tongue 1. Further, the base 4a has a belt-connecting slot 22 to connect the buckle body A with a belt (not shown).

The latch plate 5 is a generally L-shaped plate bent generally along the axis of the pivot shaft portions 13 and 13' which pivotably support the latch plate 5 in the pivot holes 14 and 14' of the side walls 4b and 4c of the frame 4. The latch plate 5 has a latch portion 5a which is generally parallel with the frame base 4a. The latch portion 5a has a downwardly extending claw 23 which is engageable with the latch hole 3 of the tongue 1, and the extensions 11 and 11' which extend out on both sides of the latch portion and are received in the segment arc windows 12 and 12' of the frame side walls 4b and 4c. A lever portion 5b extends upwards from the pivot shaft portions 13 and 13' of the latch plate 5. Between the rear face of the lever portion 5b and the spring support plate 16, a compression spring 24 is inserted to urge the latch plate 5 so that the latch portion 5a is rotated about the pivot shaft portions 13 and 13' to be generally parallel with the frame base plate 4a, as shown by arrow x in FIG. 1. The compression spring 24 only acts to maintain the cocked or ready position shown in FIG. 1, as described in more detail below, so the spring 24 may be a weaker spring than a latch spring of a conventional buckle.

The control member 6, according to the present invention, is a generally flat plate and is slidable on the latch portion 5a of the latch plate 5. The front end of the latch plate 5 has an upwardly projecting hook 27, and the middle portion of the control member 6 has an upwardly projecting hook 26. Between the hooks 26 and 27, a tension spring 28 is connected to urge the control member 6 in the tongue-release direction, i.e. direction U shown in FIG. 1. Both sides of the control member 6 have pivot preventing elements 25 and 25' which project laterally into the segment arc windows 12 and 12'. The elements 25 and 25' are large enough to cover the holes 18 and 18' of the extensions 11 and 11' of the latch plate 5 when the control member 6 slides forward to the latched position shown in FIG. 2.

Figure 3:
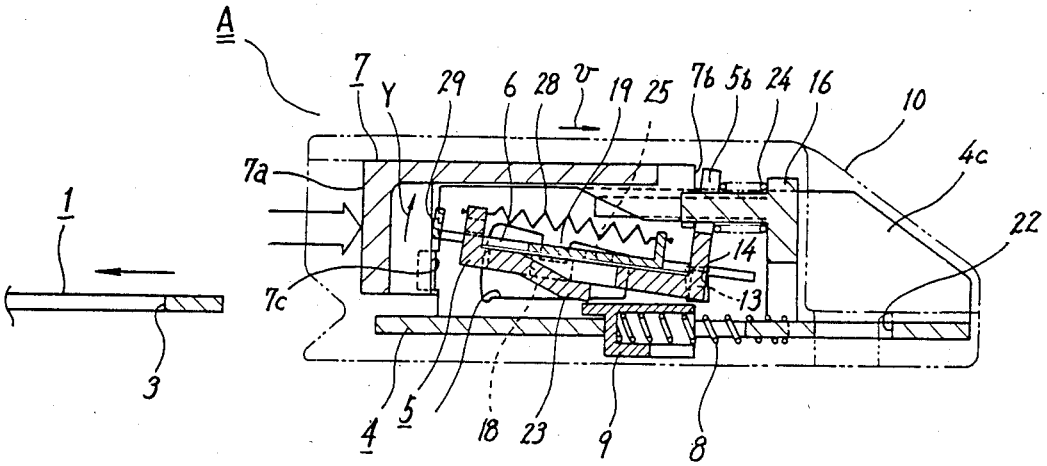

The release member 7 comprises an outwardly exposed operating surface 7a at the front end, a lever-engaging surface 7b engageable with the front surface of the lever portion 5b of the latch plate at the rear end, and a control member contact surface 7c adapted to contact with a contact portion 29 of the control member 6. The release member 7 is slidably guided by two guide rods 30 and 30' which extend forwardly from the spring support plate 16. Springs 31 and 31' engaged between the release member 7 and the spring support plate 16 urge the release member 7 in the release direction, i.e. arrow U shown in FIG. 1. The relative position of the surface 7b and the control member contact surface 7c is determined such that when the release member 7 is pushed to release the tongue 1, the control member first contacts the surface 7c and pushes the control member 6 rearward to move the elements 25 and 25' clear of the holes 18 and 18' in the latch member 5, and then the surface 7b pushes the lever portion 5b of the latch plate 5 to rotate the latch plate 5 to release the tongue 1, as shown in FIG. 3.

The operating surface 7a of the release member 7 is surrounded by the cover 10, which serves as a stop to limit its movement to the front of the buckle. Inasmuch as the release stroke of the release member 7 is relatively long and the tongue 1 can not be released until the pivot preventing elements 25 and 25' are moved out from under the end surfaces of the projections 19 and 19' of the windows 12 and 12', inadvertent release of the tongue 1 from the buckle body will not occur. Stopper pins 32 and 32' establish the forward limit of the control member 6.

The ejector 9 on the frame base 4a follows the tongue 1 forward during the releasing operation at the urging of the spring 8. At the forward-most position of the ejector 9, the front part of the ejector intrudes between the projection 23 of the latch plate 5 and the frame base 4a, as shown in FIG. 1, so that rotation of the latch plate 5 in the direction x shown in FIG. 1 is prevented.

The operation of the above-described latch buckle is as follows.

Figure 1:
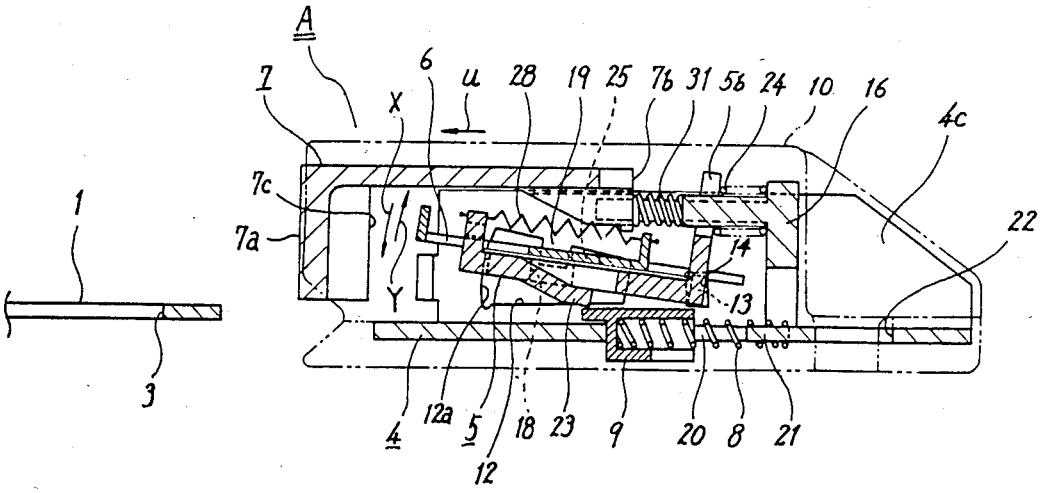

FIG. 1 shows the release position in which the buckle is cocked and ready to accept the tongue 1. The latch plate 5 is urged to rotate to direction x by the spring 24 and the projection 23 of the latch plate 5 rests on the surface of the ejector 9, which is its frontmost position.

The control member 6 is urged forward on the latch plate by the tension spring 28. The projections 19 and 19' of the windows 12 and 12' extend into the through holes 18 and 18' of the latch plate 5, and the pivot preventing elements 25 and 25' of the control member 6 are bearing against the back edges of the projections 19 and 19' so that the control member 6 is held rearwardly of its forward-most position.

Figure 2:
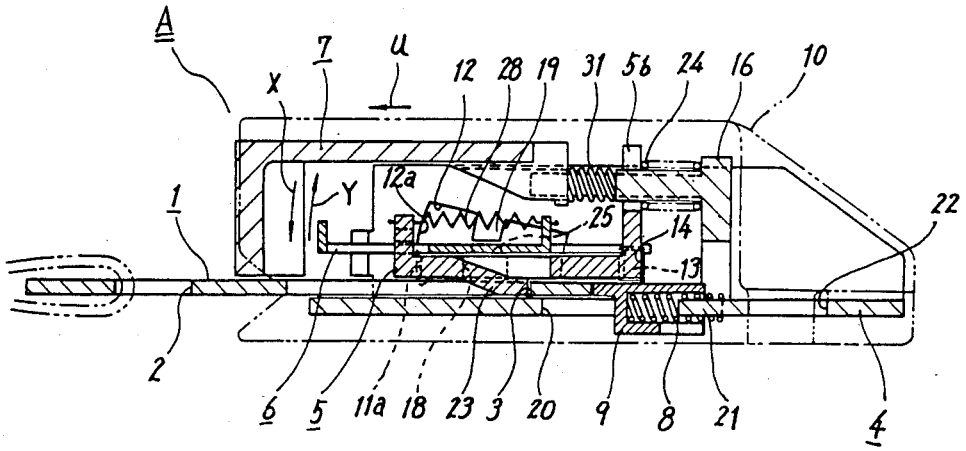

When the tongue 1 is inserted in the buckle body A, as shown in FIG. 2, the ejector 9 is pushed rearwardly against the spring 8 by the tip of the tongue 1 so that the projection 23 of the latch plate 5 is released from the ejector 9. When the tongue 1 is fully inserted to align the latch hole 3 with the projection 23, the projection 23 moves into the latch hole 3, and the latch plate 5 is rotated by the spring 24 about the pivot shaft portions 13 and 13' in the direction x shown in FIG. 1. Thus, the tongue 1 is latched to the buckle body A.

When the latch plate 5 on the control member 6 pivots downwardly, the pivot preventing elements 25 and 25' disengage the rear edges of the projections 19 and 19' of the windows 12 and 12'. The control member 6 is pulled forward by the tension spring 28 so that the pivot preventing elements 25 and 25' move forwardly under the projections 19 and 19', as shown by the arrow U. The pivot preventing elements 25 and 25' stop under the projections 19 and 19' of the windows 12 and 12' so that the holes 18 and 18' in the latch plate 5 are closed from the projections 19 and 19' by the pivot preventing elements 25 and 25'. Thus, the latch plate 5 is locked in position by the control member 6, which prevents the latch plate 5 from rotating upwardly in the direction Y, even when an abnormal shock, such as caused by a collision, is applied to the buckle. When a high load is applied to the belt tending to pull the tongue 1 in the release direction U, the load is applied to the projection 23 of the latch plate 5. The load is transmitted from the front edge surfaces 11*a* and 11*a'* of the latch plate 5 directly to the arcuate front edges 12*a* and 12*a'* of the windows 12 and 12' in the frame side walls 4*b* and 4*c*. Thus, the slender pivot shaft portions 13 and 13' of the latch plate 5 and the pivot holes 14 and 14' of the frame side walls 4*b* and 4*c* are protected from excessive loads.

FIG. 3 shows the releasing process of the tongue 1 from the buckle body A. In the latched position shown in FIG. 2, the operating surface 7*a* of the release member 7 is moved rearwardly (to the right as shown in FIG. 3) against the return springs 31 and 31'. The surface 7*c* of the release member 7 engages the contact portion 29 of the control member 6 first and pushes only the control member 6 to the right against the tension spring 28. The pivot preventing elements 25 and 25' are shifted to the right along the ends of the projections 19 and 19' to clear the holes 18 and 18' of the latch plate 5 to the projections 19 and 19' of the windows 12 and 12' of the frame side walls 4*b* and 5*c*. After the control member moves sufficiently to clear the projections 19 and 19', the surface 7*b* of the release member 7 contacts the front surface of the lever portion 5*b* of the latch plate 5 and rotates the latch plate 5 against the spring 24. As shown in FIG. 3, as the latch plate 5 rotates, the holes 18 and 18' receive the projections 19 and 19' of the windows 12 and 12', and the projection 23 is released from the latch hole 3 of the tongue 1. The ejector 9 pushes the now released tongue 1 from the buckle body A by the spring 8, and at the front position shown in FIG. 3, a portion of the ejector 9 lies under the projection 23 of the latch plate 5. When the operating force on the release member 7 is released, the release member 7 is pushed to its original position by the springs 31 and 31', as shown in FIG. 1, in which the buckle body A is ready to accept the tongue 1 again. As the release member 7 returns to the original position, the pivot preventing elements 25 and 25' of the control member are urged by the spring 18 into engagement with the edges of the projections 19 and 19' of the windows 12 and 12' of the frame side walls 4*b* and 4*c*.

It will be appreciated that the control member, according to the present invention, is slidably engaged on the latch plate, which pivots or rocks by cooperation with the release member. The control member has two positions, i.e. the pivot-preventing position which maintains the latched position of the latch plate and the latch plate releasing position. As the control member slides into the pivot-preventing position, the latch plate is positively maintained in the latched position, and the buckle cannot be released by a high impact force or by a high pulling force which is applied by shock or high inertia, such as caused by a collision. To prevent the inadvertent release, the control member is inserted between the frame member and the latch plate. Thus, a release force is applied only to portions of the control member, and the spring force has no role in keeping the latch plate in the latched position. Thus, the spring 24 which urges the latch plate to the latched position can be relatively weak. Consequently, the operating force to the release member required to release the buckle can be determined from the point of view of making the buckle easy to use.

I claim:

1. A seat belt latch buckle for retaining a buckle tongue in latched position and having a generally U-shaped frame that includes a base and a pair of side walls, a generally L-shaped latch plate pivotably supported in the side walls of the frame by reception of side extensions in generally triangular-shaped holes in the side walls and having a latching portion engageable with the tongue, a spring urging the latch plate to a tongue-latching position, a release member movable parallel to the frame base and engageable with the latch plate to pivot it out of the tongue-latching position to release the tongue, and a tongue ejector member resiliently urged along the frame base to push the released tongue out of the buckle body characterized in that a control member is slidable along the latch plate between a first position in which it engages a portion of the frame and prevents the latch plate from pivoting out of the latching position and a second position free of engagement with the frame to allow pivoting of the latch plate out of the latching position, and in that the release member has a portion engageable with a portion of the control member upon partial movement of the release member toward engagement with the latch plate to move the control member to the second position before moving the latch member to release the tongue.

2. A seat belt latch buckle according to claim 1 and further characterized in that the control member has laterally-extending projections received in the triangular-shaped holes, in that a tab extends downwardly from the upper edge of each hole, in that in the first position of the control member the projections are interposed between the extensions on the latch plate and the tabs, and in that the latch plate has holes that receive the tabs when the latch plate pivots away from the tongue-latching position.

* * * * *